US006389243B2

(12) United States Patent
Makino

(10) Patent No.: US 6,389,243 B2
(45) Date of Patent: May 14, 2002

(54) DEVELOPING DEVICE CAPABLE OF RELIABLY CHARGING DEVELOPING AGENT

(75) Inventor: Kazumasa Makino, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/727,702

(22) Filed: Dec. 4, 2000

(30) Foreign Application Priority Data

Dec. 2, 1999 (JP) ..... 11-343318

(51) Int. Cl.[7] ..... G03G 15/06
(52) U.S. Cl. ..... 399/53; 399/43; 399/127
(58) Field of Search ..... 399/53, 61, 27, 399/29, 38, 43, 46, 75, 127

(56) References Cited

U.S. PATENT DOCUMENTS 5,404,213 A * 4/1995 Okano et al. ..... 399/127
5,923,922 A * 7/1999 Ishida et al. ..... 399/53 X
6,006,050 A * 12/1999 Watanabe et al. ..... 399/61 X

FOREIGN PATENT DOCUMENTS

JP 02-018583 * 1/1990
JP 04-043378 * 2/1992
JP 05-088533 * 4/1993

* cited by examiner

*Primary Examiner*—Sophia S. Chen
(74) *Attorney, Agent, or Firm*—Oliff & Berridge, PLC

(57) ABSTRACT

A developing unit includes a photosensitive drum, a developing drum, and an agitator. When a charge of toner has dropped below a predetermined charging amount before a subsequent image forming operation starts, a pre-driving operation is performed so that the developing drum and the agitator are rotated before a sheet feed operation starts. Therefore, sufficient charge can be applied to the toner before a developing operation starts, thereby providing a high-quality image. Also, because the photosensitive drum and the developing roller are separated from each other during the pre-driving operation, the photosensitive drum and the developing roller are prevented from being worn down.

25 Claims, 8 Drawing Sheets

DEVELOPING DEVICE CAPABLE OF RELIABLY CHARGING DEVELOPING AGENT

BACKGROUND OF THE INVENTION

1. Field of the Invention

The present invention relates to a developing unit and an image forming device including the developing unit.

2. Description of the Related Art

Generally, laser printers that use non-magnetic single component toner include a process cartridge for developing images. This process cartridge includes a photosensitive drum, an agitator a toner camber, a supply roller, a developing roller, and a thickness regulating blade.

The agitator is provided in the toner chamber for agitating toner housed in the toner chamber in order to apply a charge to the toner and also to discharge the toner toward the supply roller. Rotation of the supply roller supplies the discharged toner to the developing roller. The toner thickness regulating blade applies pressure to the developing roller to form a uniform thin-thickness toner layer on the developing roller. At this time, friction between the thickness regulating blade and the developing roller applies sufficient charge to the toner.

The laser printer also includes a charging unit and a laser emitting unit. The charging unit uniformly charges the surface of the photosensitive drum. The laser emitting unit scans the uniformly charged surface of the photosensitive drum with a laser beam at a high rate of speed based on image data, thereby forming an electrostatic latent image on the photosensitive drum. When the electrostatic latent image comes into confrontation with the charged toner carried on the developing roller as the photosensitive drum rotates, the toner is selectively transferred onto the photosensitive drum to develop the electrostatic latent image into a visible toner image.

A paper sheet is fed by sheet feed rollers from a paper supply cassette. While the paper sheet is transported between the photosensitive drum and a transfer roller, the toner image formed on the photosensitive drum is transferred onto the paper sheet. Then, fixing rollers fix the toner image onto the paper sheet, and discharge rollers discharge the paper sheet.

In this type of image forming device, the agitator and the developing roller are constantly driven. That is, the toner particles are constantly colliding with one another in the toner chamber because of the rotation of the agitator. Also, the toner particles are constantly scraped between the toner thickness regulating blade and the developing roller because of the rotation of the developing roller. This degrades the toner and also wears down the developing roller.

In order to overcome such problems, there has been provided a control method to control the agitator and the developing roller to start rotating when a paper sheet is supplied and to stop the rotation when a toner image is completely transferred onto the paper sheet.

However, when a prescribed time has elapsed after a previous image forming operation has been completed, the charge of the toner that was charged during the previous image forming operation gradually drops. In this case, even if the agitator and the developing roller start rotating when a paper sheet is supplied for a subsequent image forming operation, the toner will not be sufficiently charged by the time developing operations are performed. Such insufficiently charged toner gives rise to poorly developed images.

SUMMARY OF THE INVENTION

In view of the foregoing, it is an object of the present invention to overcome the above-described problems, and also to provide a developing unit and an image forming device including the developing unit capable of developing high-quality images using adequately charged toner even during an image forming operation performed a prescribed time after completion of a previous image forming operation.

In order to achieve the above and other objectives, there is provided a developing device used in an image forming device including a feeding mechanism that feeds a recording medium. The image forming device performs an image forming operation based on image data received from an external device for forming an image on the recording medium. The developing device includes a photosensitive member, a developing agent chamber, a developing unit, an agitating member, a judging unit, and a driving member. The developing agent chamber houses a developing agent. The developing unit selectively supplies the developing agent housed in the developing agent chamber to the photosensitive member. The agitating member is housed in the developing agent chamber and agitates the developing agent housed in the developing agent chamber. The judging unit judges whether or not a charging amount of the developing agent is sufficient or insufficient when the image forming operation is started. The driving member drives the agitating member and the developing unit. When the judging unit judges that the charging amount of the developing agent in insufficient, the driving member starts driving at least one of the developing unit and the agitating member before the feeding mechanism starts feeding the recording medium.

There is also provided a developing device used in an image forming device. The image forming device includes a feeding mechanism that feeds a recording medium and performs an image forming operation based on image data received from an external device for forming an image on the recording medium. The developing device includes a photosensitive member, a developing agent chamber, an agitating member, a judging unit, and a driving member. The developing agent chamber houses a developing agent. The developing unit supplies the developing agent housed in the developing agent chamber to the photosensitive member. The agitating member is housed in the developing agent chamber and agitates the developing agent housed in the developing agent chamber. The judging unit judges whether a charging amount of the developing agent is sufficient or insufficient. The driving member drives the agitating member and the developing unit. When the judging unit judges that the charging amount of the developing agent is insufficient, the driving member drives at least one of the developing unit and the agitating member for a time duration longer than when the judging unit judges that the charging amount of the developing agent is sufficient.

Further, there is also provided an image forming device for performing an image forming operation. The image forming device includes a feeding mechanism, a photosensitive member, a developing agent chamber, a developing unit an agitating member, a judging unit, and a driving member. The feeding mechanism feeds a recording medium. The developing agent chamber houses a developing agent. The developing unit selectively supplies the developing agent housed in the developing agent chamber to the photosensitive member. The agitating member is housed in the developing agent chamber and agitates the developing agent housed in the developing agent chamber. The judging unit judges whether or not a charging amount of the developing agent is sufficient or insufficient when the image forming operation is started. The driving member drives the agitating member and the developing unit. When the judging unit judges that the charging amount of the developing agent is insufficient, the driving member starts driving at least one of the developing unit and the agitating member before the feeding mechanism starts feeding the recording medium.

DETAILED DESCRIPTION OF THE PREFERRED EMBODIMENT

An image forming device including a developing unit according to an embodiment of the present invention will be described while referring to the accompanying drawings.

Figure 1:
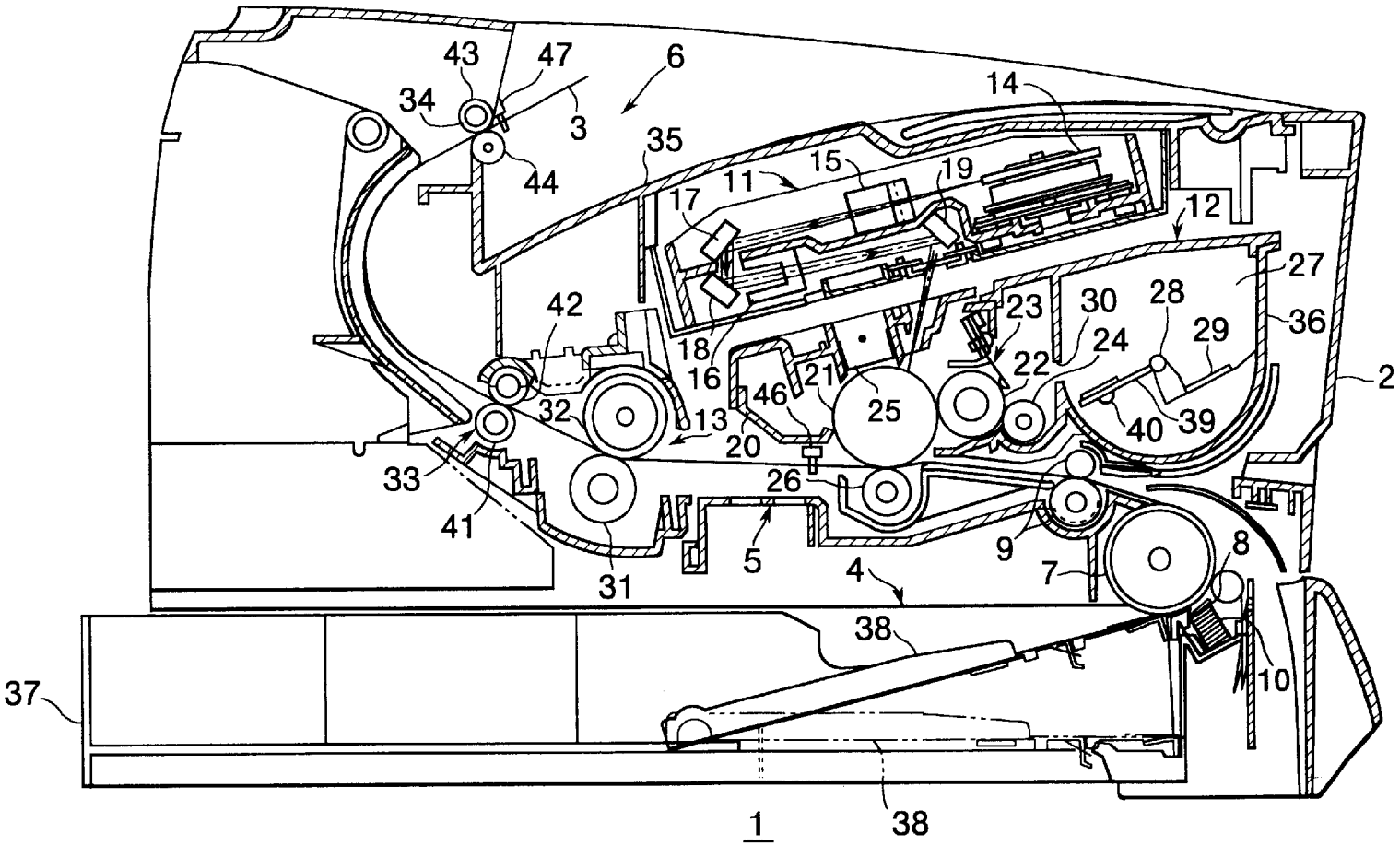
FIG. 1 is a side cross-sectional view showing a laser printer according to an embodiment of the present invention.

First, overall configuration of a laser printer 1 will be described while referring to FIG. 1. As shown in FIG. 1, the laser printer 1 includes a main casing 2, a feeder unit 4, an image forming unit 5, and a discharge unit 6.

The feeder unit 4 includes a paper supply cassette 37, a pressure plate 38, a sheet feed roller 7, a sheet feed pad 8, register rollers 9, and a spring 10. The paper supply cassette 37 is detachably mounted on the bottom of the main casing 2. The paper pressure plate 38 is disposed in the cassette 37. The sheet feed roller 7 and the sheet feed pad 8 are disposed above one end of the cassette 37. The spring 10 is disposed on the underside of the sheet feed pad 8. The register rollers 9 are disposed on the downstream of the sheet feed roller 7 in a sheet feed direction of the paper sheet 3.

The pressure plate 38 is pivotable on one end far from the sheet feed roller 7 such that the other end near the sheet feed roller 7 can move up and down. The pressure plate 38 supports a stack of paper sheets 3. A spring (not shown) is disposed on the underside of the pressure plate 38 so as to urge the pressure plate 38 upward, thereby urging the topmost paper sheet 3 on the pressure plate 38 against the sheet feed roller 7. As the amount of paper sheets 3 stacked on the pressure plate 38 increases, the pressure plate 38 pivots downward about the one end in opposition to the urging force of the spring.

The sheet feed pad 8 is disposed in confrontation with the sheet feed roller 7. The spring 10 urges the sheet feed pad 8 against the sheet feed roller 7. The rotation of the sheet feed roller 7 picks up a paper sheet 3 one at a time from the top of the stack of paper sheets 3. The picked-up paper sheet 3 is sandwiched between the sheet feed roller 7 and the sheet feed pad 8, and then transported in the sheet feed direction to the register rollers 9. The register rollers 9 include a drive roller and a follower roller. The register rollers 9 registers the paper sheet 3 and further feeds the paper sheet 3 to the image forming unit 5.

The image forming unit 5 includes a scanner unit 11, a developing unit 12, and a fixing unit 13.

The scanner unit 11 is provided in the top of the main casing 2 and includes a laser emitting section (not shown), a polygon mirror 14, lenses 15 and 16, and reflecting mirrors 17, 18, 19. The laser emitting section emits a laser beam based on image data. As indicated by a broken line in FIG. 1, the laser beam emitted from the laser emitting section passes through or reflects off the polygon mirror 14, the lens 15, the reflecting mirror 17, the reflecting mirror 18, the lens 16, and the reflecting mirror 19 in this order. The laser beam is subsequently irradiated in a high-speed scanning motion across the surface of a photosensitive drum 21 (described alter) in the developing unit 12.

The developing unit 12 is disposed beneath the scanner unit 11 and includes a drum cartridge 20 detachably mounted on the main casing 2. The drum cartridge 20 houses a photosensitive drum 21, a developing cartridge 36, a scorotron charger 25, and a transfer roller 26. The developing cartridge 36 is detachably mounted on the drum cartridge 20 and includes a developing roller 22, a toner thickness regulating blade 23, a supply roller 24, and a toner box 27. The toner box 27 is formed with a toner supply opening 30 in its side.

The toner box 27 accommodates a positively charging non-magnetic single component toner having electrical insulation capacity. The toner box 27 also accommodates a rotating shaft 28 disposed in the center of the toner box 27. An agitator 29 is supported on the rotating shaft 28 and extends outward in the radial direction of the rotating shaft 28. The agitator 29 agitates the toner in the toner box 27. Mutual contact between the toner particles generates a positive charge in the toner particles through friction charging. A portion of the toner is discharged through the toner supply opening 30 out of the toner box 27.

A window 40 is provided in the side wall of the toner box 27 for detecting the amount of toner remaining in the toner box 27. Also, a cleaner 39 is supported on the rotating shaft 28 for cleaning the window 40.

The supply roller 24 is rotatable positioned to the side of the toner supply opening 30. The developing roller 22 is rotatably disposed in contact with the supply roller 24 such that these two apply some pressure to each other. The supply roller 24 includes a metal roller shaft covered by a roller portion that is formed of a conductive foam material. The developing roller 22 includes a metal roller shaft covered by a roller portion that is formed of a conductive rubber material. A transfer bias having a reverse polarity to the photosensitive drum 21 is applied to the developing roller 22.

The toner thickness regulating blade 23 is disposed adjacent to the developing roller 22. The toner thickness regulating blade 23 includes a blade portion formed of a metal flat spring and a contact portion attached to one and of the blade portion. The contact portion is formed in a semicircular cross-sectional shape from an insulating silicon rubber. The contact portion presses against the developing roller 22 by the urging force of the blade portion. Toner discharged through the toner supply opening 30 is supplied onto the supply roller 24, and further onto the developing roller 22 by the rotation of the supply roller 24. As the developing roller 22 rotates, the toner carried on the developing roller 22 enters between the developing roller 22 and the toner thickness regulating blade 23 where the toner is sufficiently charged through friction charging and formed into a uniform-thickness thin toner layer on the developing roller 22.

The photosensitive drum 21 is rotatably provided in contact with the developing roller 22. The photosensitive drum 21 includes a main drum which is grounded. The surface of the photosensitive drum 21 is formed of a positively charging material, such as an organic photosensitive member including primarily polycarbonate. The scorotron charger 25 is disposed above the photosensitive drum 21 with a prescribed distance therebetween. The scorotron charger 25 is a positively charging charger that generates a corona discharge from a charging wire made from tungsten or other material. The scorotron charger 25 uniformly and positively charges the entire surface of the photosensitive drum 21.

The uniformly charged surface of the photosensitive drum 21 is then selectively exposed by the high-speed scan of a laser beam emitted from the scanner unit 11 based on image data. As a result, the exposed portion of the photosensitive drum 21 is decreased in its positive charge, thereby forming an electrostatic latent image on the photosensitive drum 21. When the positively charged toner is brought into contact with the photosensitive drum 21 by the rotation of the developing roller 22, the toner is selectively transferred onto photosensitive drum 21, thereby developing the electrostatic latent image into a visible toner image. In this way, a mirror-image-reversal-type developing process is performed.

The transfer roller 26 is rotatably disposed below and in contact with the photosensitive drum 21. The transfer roller 26 includes a metal roller shaft covered by a roller portion formed of a conductive rubber material. A transfer bias of reverse polarity to the photosensitive drum 21 is applied to the transfer roller 26. Accordingly, the visible toner image carried on the photosensitive drum 21 is transferred to the paper sheet 3 while the paper sheet 3 passes between the photosensitive drum 21 and the transfer roller 26.

The fixing unit 13 is disposed downstream of the developing unit 12 in the sheet feed direction, and includes a heating roller 32 and a pressure roller 31 that applies pressure to the heating roller 32. The heating roller 32 is formed of a metal and is provided with a halogen lamp for generating heat. When the sheet 3 with the toner image formed thereon passes between the heating roller 32 and the pressure roller 31 the toner image is thermally fixed to the paper sheet 3.

The discharge unit 6 includes conveying rollers, a discharge rollers 34, and a discharge tray 35. The conveying rollers 33 are disposed downstream from the fixing unit 13 in the sheet feed direction and include a drive roller 41 and a follower roller 42. The conveying rollers 33 feed the sheet 3 fed from the fixing unit 13 toward the discharge rollers 34. The discharge rollers 34 include a drive roller 43 and a follower roller 44 for gripping the paper sheet 3 therebetween. The discharge tray 35 is formed in a depression shape on the top of the main casing 2 and below the discharge rollers 34. The sheet 3 fed from the conveying rollers 33 are discharged by the discharge rollers 34 onto the discharge tray 35 in a stacked manner.

Also, a sensor 46 is provided downstream from the transfer roller 26 in the sheet feed direction for detecting passage of a paper sheet 3. A discharge sensor 47 is disposed downstream from the discharge roller 34 in the sheet feed direction for detecting the discharge of the paper sheet 3.

Figure 2:
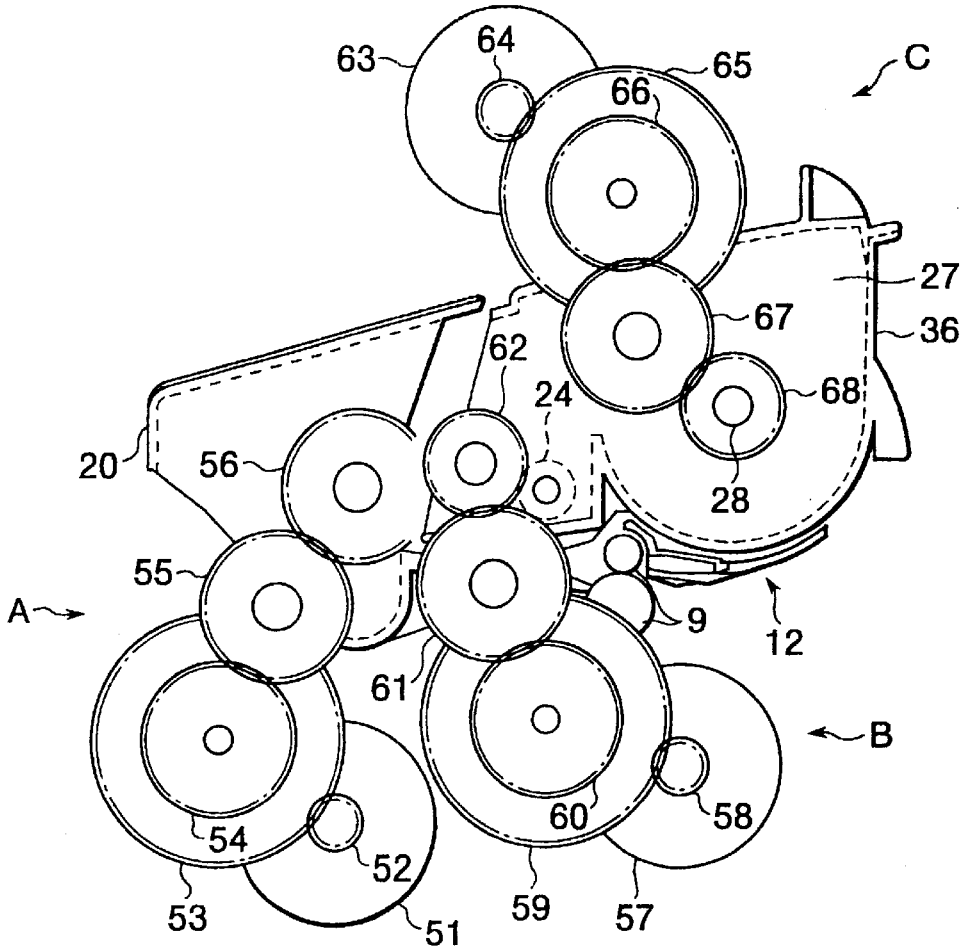
FIG. 2 is a side cross-sectional view showing a driving mechanism of the laser printer of FIG. 1.

Next, a driving mechanism for independently driving the photosensitive drum 21, the developing roller 22, and agitator 29 will be described next. As shown in FIG. 2, the driving mechanism according to the present embodiment includes a drum driving mechanism A, a roller driving mechanism D, and an agitator driving mechanism C for driving the photosensitive drum 21, the developing roller 22, and the agitator 29, respectively.

The drum driving mechanism A includes a drum drive motor 51, a pinion gear 52, a first intermediate gear 53, a second intermediate gear 54, a third intermediate gear 55, and a photosensitive drum driving gear 56. The drum drive motor 51 is disposed below the photosensitive drum 21. The pinion gear 52 is provided on the drum drive motor 51. The first intermediate gear 53 is engaged with the pinion gear 52. The second intermediate gear 54 has a diameter smaller than that of the first intermediate gear 53, and is coaxially and integrally formed with the first intermediate gear 53. The second intermediate gear 54 engages with the third intermediate gear 55. The photosensitive drum driving gear 56 engages with the third intermediate gear 55, and is formed on the side of the photosensitive drum 21 in its axial direction. With this configuration, the driving force of the drum drive motor 51 is transmitted via the pinion gear 52, the first intermediate gear 53, the second intermediate gear 54, the third intermediate gear 55, and the driving gear 56 to the photosensitive drum 21, thereby rotating the photosensitive drum 21.

The roller driving mechanism B includes a roller drive motor 57, a pinion gear 58, a fourth intermediate gear 59, a fifth intermediate gear 60, a sixth intermediate gear 61, and a developing roller driving gear 62. The roller drive motor 57 is disposed below the developing roller 22. The pinion gear 58 is provided on the roller drive motor 57 and engages with the fourth intermediate gear 59. The fifth intermediate gear 60 has a diameter smaller than that of the fourth intermediate gear 59, and is coaxially and integrally formed with the fourth intermediate gear 59. The fifth intermediate gear 60 engages the sixth intermediate gear 61. The developing roller driving gear 62 engages the sixth intermediate gear 61 and is formed on the side of the developing roller 22 in the axial direction of the developing roller 22. With this configuration, the driving force of the roller drive motor 57 is transmitted via the pinion gear 58, the fourth intermediate gear 59, the fifth intermediate gear 60, the sixth intermediate gear 61, and the developing roller driving gear 62 to the developing roller 22. thereby rotating the developing roller 22.

The agitator driving mechanism C includes an agitator drive motor 63, a pinion gear 64, a seventh intermediate gear 65, an eighth intermediate gear 66, a ninth intermediate gear 67, and an agitator driving gear 68. The agitator drive motor 63 is disposed above the agitator 29. The pinion gear 64 is provided on the agitator drive motor 63 and engages with the seventh intermediate gear 65. The eighth intermediate gear 66 has a diameter smaller than that of the seventh intermediate gear 65, and is coaxially and integrally formed with the seventh intermediate gear 65. The eighth intermediate gear 66 engages With the ninth intermediate gear 67. The agitator driving gear 68 engages with the ninth intermediate gear 67, and is formed on the axial side of the rotating shaft 28 that is supporting the agitator 29. With this configuration, the driving force of the agitator drive motor 63 is transmitted to the pinion gear 64, the seventh intermediate gear 65, the eighth intermediate gear 66, the ninth intermediate gear 67 and the driving gear 68 to the rotating shaft 28, thereby rotating the rotating shaft 28. Accordingly, the agitator 29 is rotated.

With this configuration, the driving mechanism can individually drive the photosensitive drum 21, the developing roller 22, and the agitator 29 at an accurate timing in a manner described later.

Although not shown in the drawings, the drive force of the drum drive motor 51 is also transmitted to the sheet feed roller 7, the register rollers 9, the transfer roller 26, the conveying roller 33, and the discharge roller 34 via a gear train and a clutch mechanism that stops and starts the driving of the gear train. Hence, the drum drive motor 51 drives the above components appropriately to perform sheet feeding operations, image transfer operations, sheet conveying operations, and sheet discharge operations.

Figure 3:
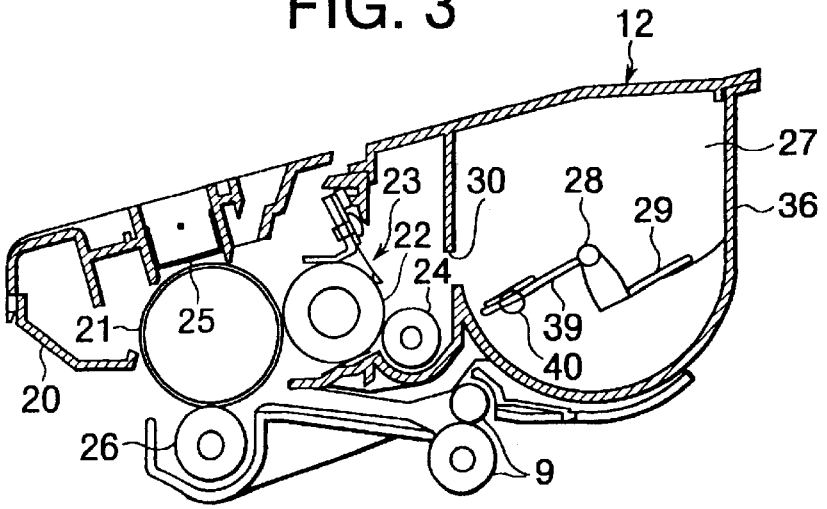
FIG. 3 is an enlarged cross-sectional view showing a condition of a developing unit of the laser printer in which a photosensitive drum and a developing roller are in contact with each other.
Figure 4:
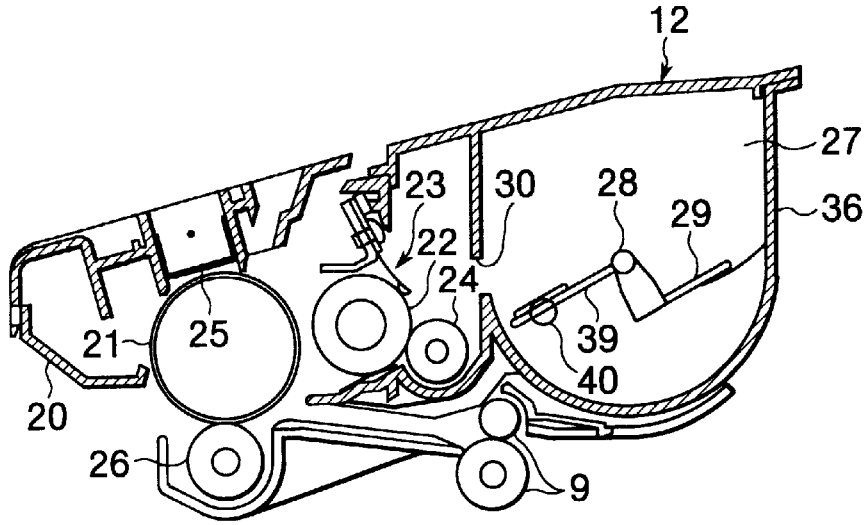
FIG. 4 is an enlarged cross-sectional view showing a condition of the developing unit of the laser printer in which the photosensitive drum and the developing roller are separated from each other.

The laser printer 1 also includes a contact/separation mechanism for contacting and separating the developing roller 22 and the photosensitive drum 21. As shown in FIG. 3, the photosensitive drum 21 and the developing roller 22 are in contact with each other during the developing processes in which the toner carried on the developing roller 22 is selectively transferred onto the photosensitive drum 21. On the other hand, as shown in FIG. 4, the photosensitive drum 21 and the developing roller 22 are separated by a prescribed interval when either one of the photosensitive drum 21 or the developing roller 22 is independently driven to rotate. These contact and separation timings are determined according to a predriving program to be described later.

Figure 5:
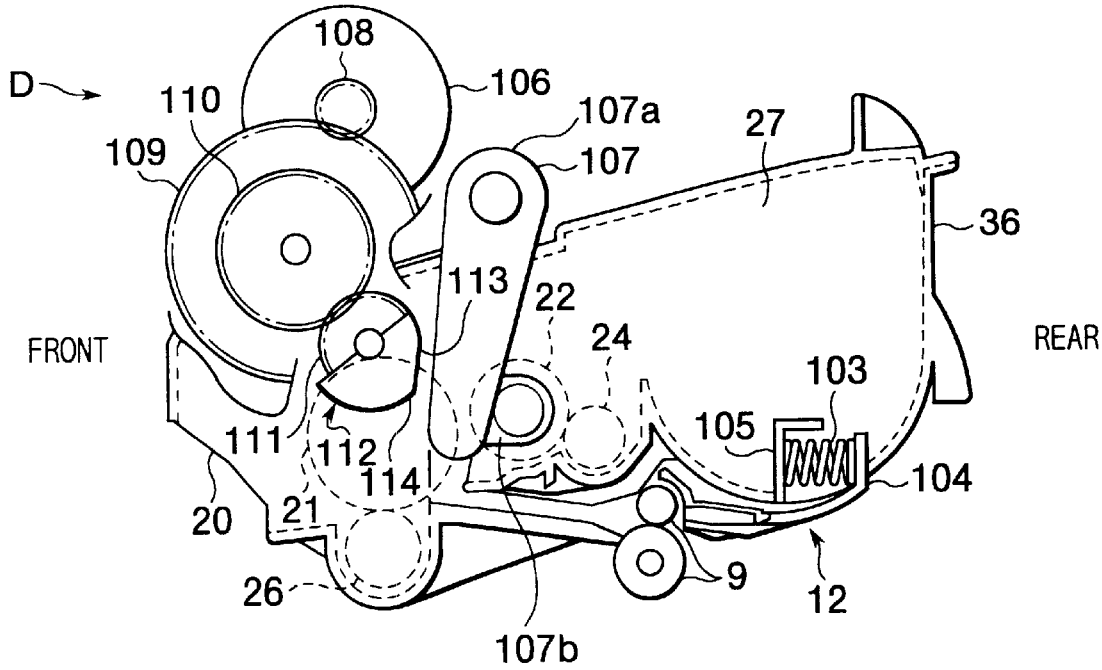
FIG. 5 is a side cross-sectional view showing a contact/separating mechanism of the laser printer.

Next, the contact/separation mechanism will be described. The developing cartridge 36 is formed movable forward and backward in relation to the drum cartridge 20. As shown in FIG. 5, a receiving member 104 is formed on the back end of the drum cartridge 20. Also, a receiving member 105 is formed on the developing cartridge 36 at a position in front of the receiving member 104. A spring 103 is inserted between the receiving member 104 and the receiving member 105. The urging force of the spring 103 urges the developing cartridge 36 forward in relation to the drum cartridge 20. Because the developing cartridge 36 is urged forward toward the drum cartridge 20, the developing roller 22 is constantly urged to contact the photosensitive drum 21.

A pivot arm 107 is provided above the developing cartridge 36. The pivot arm 107 is pivotable about one end 107*a*. The other end of the pivot arm 107*b* is mounted on a roller shaft 22*a* of the developing roller 22.

An arm driving mechanism D is provided for pivoting the pivot arm 107. The arm driving mechanism includes a separating motor 106, a pinion gear 108, a thirty-first intermediate gear 109, a thirty-second intermediate gear 110, a cam drive sear 111, and a cam member 112.

The separating motor 106 is disposed above the photosensitive drum 21. The pinion gear 108 is provided on the separating motor 106 and is engaged with the thirty-first intermediate gear 109. The thirty-second intermediate gear 110 is coaxially and integrally formed with the thirty-first intermediate gear 109. The thirty-second intermediate gear 110 engages with the cam drive gear 111. The cam member 112 in provided on the cam drive gear 111 in contact with the pivot arm 107. With this configuration, the driving force of the separating motor 106 is transmitted via the pinion gear 108, the thirty-first intermediate gear 109, the thirty-second intermediate gear 110, and the cam drive gear 111 in this order, to the cam member 112, thereby rotating the cam member 112.

Figure 6:
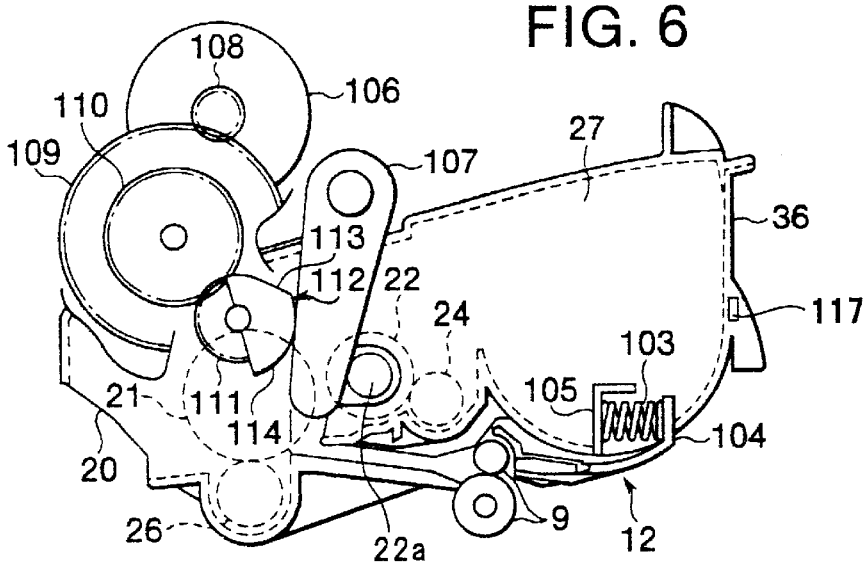
FIG. 6 is a side cross-sectional view showing the contact/separating mechanism in a separating condition of FIG. 5.

The cam member 112 is formed with a flat surface portion 113 and a distended surface portion 114. When the flat surface portion 113 is in confrontation with the pivot arm 107 as shown in FIG. 5, the cam member 112 does not push on the pivot arm 107. Accordingly, the urging force of the spring 103 urges the developing roller 22 to contact the photosensitive drum 21. On the other hand, when the cam member 112 is rotated by the driving force of the separating motor 106, such that the distended surface portion 114 comes into confrontation with the pivot arm 107 as shown in FIG. 6, the pivot arm 107 is forced backward by the cam member 112 in opposition to the urging force of the spring 103. Hence, the developing cartridge 36 moves in the rearward direction away from the drum cartridge 20. As a result, the developing roller 22 Is forced to separate from the photosensitive drum 21.

With this configuration, it is possible to separate the photosensitive drum 21 and the developing roller 22 when only one of the photosensitive drum 21 and the developing roller 22 is driven to rotate. Therefore, it is possible to prevent the rotating one of the photosensitive drum 21 and the developing roller 22 from rubbing against the unrotating one. This ensures the reliable operations to selectively transfer toners from the developing roller 22 onto the photosensitive drum. Also, wear and tear on the photosensitive drum 21 and the developing roller 22 can be reduced, thereby improving durability of these components. Further, in the present embodiment, the forward and backward movement of the developing cartridge 36 in relation to the drum cartridge 20 contacts and separates the photosensitive drum 21 and the developing roller 22 each other as described above. Because this movement is lateral (front and rear direction), toner sealing configuration of the developing cartridge 36 can be easily achieved.

Figure 9:
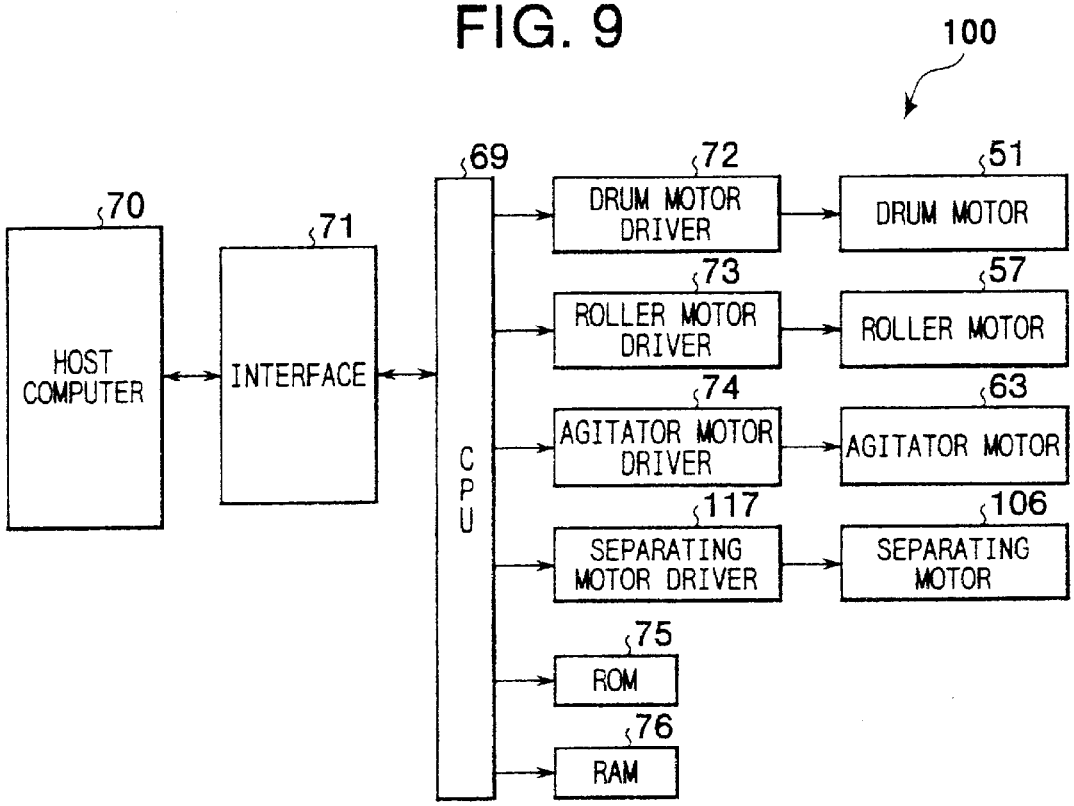
FIG. 9 is a block diagram showing a control system of the laser printer.

The laser printer 1 of the present embodiment is also provided with a control unit 100 shown in FIG. 9. As shown in FIG. 9, the control unit 100 includes a central processing unit (CPU) 69, an interface 71, a drum motor driver 72, a roller motor driver 73, an agitator motor driver 74, a separating motor driver 117, a read only memory (RON) 75, and a random access memory (RAM) 76. The interface 71 transmits and receives data to and from the host computer 70. The drum motor driver 72 is for driving the drum drive motor 51. The roller motor driver 73 is for driving the roller drive motor 57. The agitator motor driver 74 is for driving the agitator drive motor 63. The separating motor driver 117 is for driving the separating motor 106. The ROM 75 stores various control programs including those necessary for forming images and the pre-driving program. The RAM 76 includes various memory areas and buffers for performing the control operations.

Figure 10:
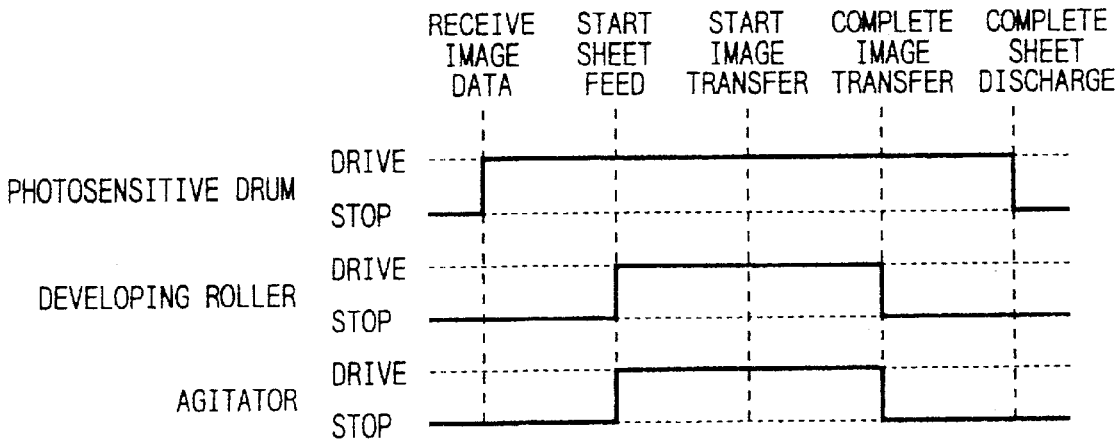
FIG. 10 is a timing chart showing drive timings of the photosensitive drum, the developing roller, and an agitator during a normal image forming operation.

In the laser printer 1 with the above-described configuration, the photosensitive drum 21, the developing roller 22, and the agitator 29 are driven at prescribed timings shown in FIG. 10 during the normal image forming operations for consecutively forming images on paper sheets 3. That is, when the image forming operation starts, image data is received from the host computer 70 via the interface 71. At the same time, the drum drive motor 51 is driven, thereby driving the photosensitive drum 21. That is, the photosensitive drum 21 starts rotating at the timing of when the image data is inputted. Next, sheet feed operation is started so that the sheet feed roller 7, which is driven by the drum drive motor 51, feeds a paper sheet 3. At the same time, the photosensitive drum 21 and the developing roller 22 are brought into contact with each other by the driving force of the separating motor 106. Also, the roller drive motor 57 and the agitator drive motor 63 are driven, thereby driving the developing roller 22 and the agitator 29. That is, the developing roller 22 and the agitator 29 are driven at the same time the sheet feed operation is started. Then, the transfer operation starts to transfer a toner image from the photosensitive drum 21 onto the paper sheet 3. When the trailing edge of the paper sheet 3 passes between the photosensitive drum 21 and the transfer roller 26, which indicates completion of the transfer operation, the developing roller 22 and the photosensitive drum 21 are separated, and the roller drive motor 57 and the agitator drive motor 63 are stopped. That is rotation of the developing roller 22 and the agitator 29 is stopped simultaneously with completion of the transfer process. Then, after the discharge roller 34 discharges the paper sheet 3, the drum drive motor 51 is stopped so that rotation of the discharge roller 34 stops. That is, rotation of the photosensitive drum 21 is stopped simultaneously with completion of the sheet discharge process.

This method can effectively prevent deterioration of the toner caused by excessive driving of the developing roller 22 and the agitator 29.

However, once a prescribed time elapses after completion of the image forming operation, the toner charged by the agitator 29 and the developing roller 22 gradually loses its charge. As a result, it is not possible to achieve a sufficient charge in the next image forming process by starting drive of the agitator 29 and the developing roller 22 at the timing when the sheet feed operation starts. This insufficiently charged toner can lead to unsatisfactory image formation. Therefore, in the laser printer 1 of the present embodiment, the developing roller 22 and the agitator 29 are driven before the sheet feed operation when it is determined, in a manner to be described below, the toner charge has dropped below a predetermined charge sufficient for forming images. This process is performed according to the pre-driving program stored in the ROM 75.

Figure 11:
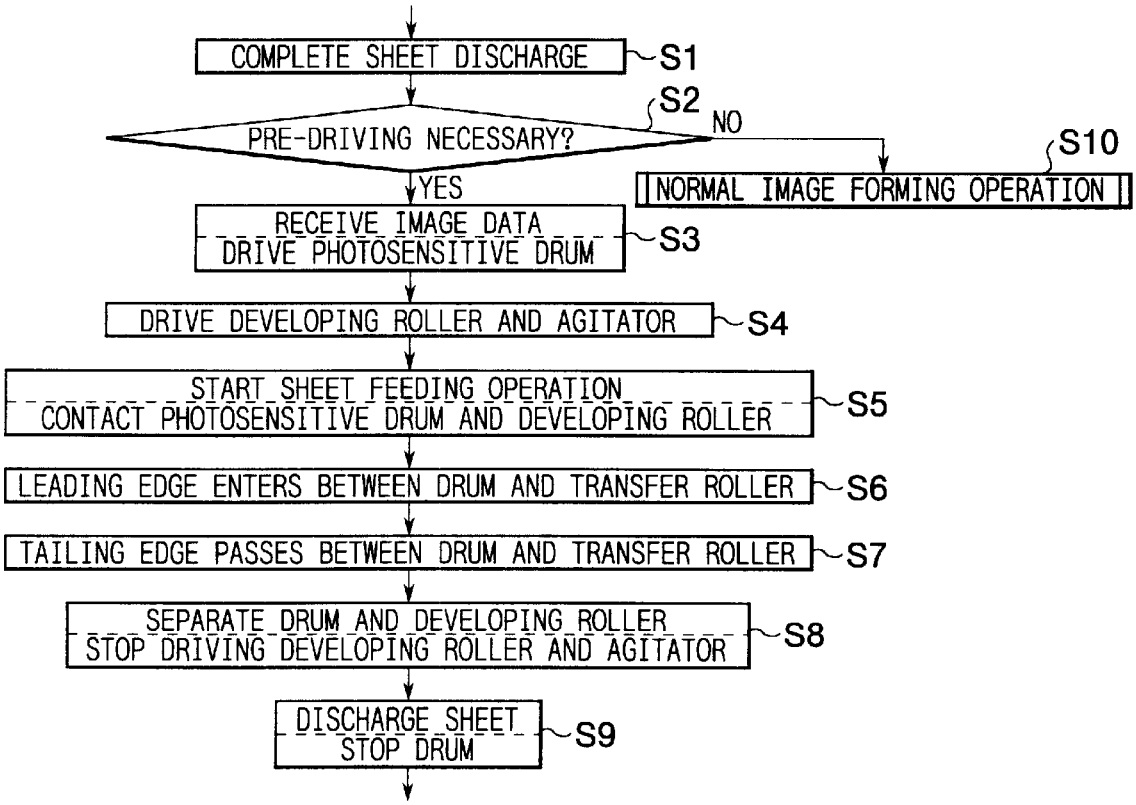
FIG. 11 is a flowchart representing a process performed in the laser printer
Figure 13:
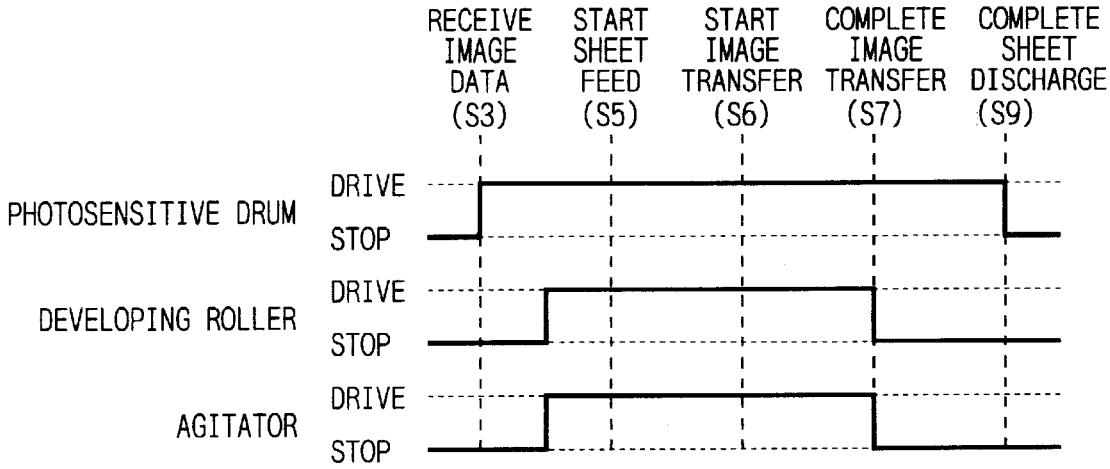
FIG. 13 is a timing chart showing drive timings of the photosensitive drum, the developing roller, and the agitator according to an pre-driving program.

Next, processes of the pro-driving program executed by the CPU 69 of the control unit 100 will be described while referring to FIGS. 11 and 13. FIG. 11 shows the flowchart that represents a control process. FIG. 13 shows the driving timing or the photosensitive drum 21, the developing roller 22, and the agitator 29 when these are controlled according to the pre-driving program.

A paper sheet 3 is discharged when a printing operation is completed in S1. Then, it is determined in S2 whether or not it is necessary to perform a pre-driving operation for driving the developing roller 22 and the agitator 29 before feeding the next paper sheet 3. The determination in S2 can be made based on selected various determining elements. For example, a charge detecting sensor 117, such as a coulombmeter, can be provided inside the developing cartridge 36 for detecting a charge of the toner. When the sensor detects that the charge is not sufficient for forming images, then it can be determined that a pre-drive operation is necessary. More specifically, it may be determined that a pre-drive operation is necessary when the charge level has dropped below 15 $\mu$C/g. This method enables a uniform determination. Therefore, the developing roller 22 and the agitator 29 can be driven based on the uniform determination.

Alternatively, it can be determined that the pre-drive operation is necessary if a prescribed time, three minutes for example, has elapsed. Specifically, it may be determined that the pre-drive operation is necessary when three minutes have elapsed after the developing roller 22 and the agitator 29 stop or after the paper sheet 3 is discharged. Hence, this method enables a uniform determination of the toner charge level based on the passage of time rather than on the drop in toner charge, eliminating the need to provide a separate charge detecting sensor.

The program can be designed so that the charge level of the toner is automatically determined to have dropped below the level required for forming images each time the power is turned ON, the developing cartridge 36 is replaced with new one, and the laser printer 1 so restored from a sleep mode.

If it is determined in S2 that the pre-drive operation is not necessary (S2:No), then in S10, the normal image forming operation described above with reference to FIG. 10 is performed. Here, the developing roller 22 and the agitator 29 are driven at the same time as when the sheet feed operation is started.

On the other hand, when it is determined that the pre-driving operation is necessary (S2:YES), then the laser printer 1 is controlled according to the pre-driving program. FIG. 13 shows the driving timings of the photosensitive drum 21, the developing roller 22, and the agitator 29 according to the pre-driving program. That is, in S3, the drum drive motor 51 starts driving at the same time as when reception of image data starts from the host computer 70 via the interface 71. That is, the photosensitive drum 21 starts rotating at the same timing as the image data is received. Next in 94, the roller drive motor 57 and the agitator drive motor 63 are driven prior to the sheet feed operation in order to perform the pre-drive operation of the developing roller 22 and the agitator 29.

The timing to start the pre-driving operation may be determined by using a timer. For example, an input signal of the image data inputted in S3 may be used as a trigger to start the timer. When the timer measures that the prescribed time duration has elapsed, drive of the roller drive motor 57 and the agitator drive motor 63 is started. This timing control method ensures that the developing roller 22 and the agitator 29 are driven at a reliable timing.

It is preferable that the timing is set so that at least one of the developing roller 22 and the agitator 29 completes at least one full rotation before the sheet feed operation starts. Alternatively, the timing can be set so that the agitator 29 completes at least two full rotations before the sheet feed operation starts. By setting the pre-driving timing in this manner, the toner to be provided for the developing operation will be sufficiently charged. In this case, a time duration required for allowing the developing roller 22 to complete one full rotation can be calculated, so that the roller drive motor 57 and the agitator drive motor 63 will be driven at least the calculated time duration, three seconds for example, before the sheet feed operation starts.

Next in S5, the driving force of the separating motor 106 brings the photosensitive drum 21 and the developing roller 22 into contact each other at the same time that drive of the drum drive motor 51 starts so that the sheet feed roller 7 performs the sheet feed operation to feed the paper sheet 3. Subsequently, in S6, the leading edge of the paper sheet 3 enters between the photosensitive drum 21 and the transfer roller 26, whereupon a toner image is transferred onto the paper sheet 3. Then, in S7, it is judged that the trailing edge of the paper sheet 3 passes between the photosensitive drum 21 and the transfer roller 26. This indicates the completion of the transfer operation. The judgement in S7 can be made by using the sensor 46. Then in S8, the separating motor 106 is driven to separate the photosensitive drum 21 and the developing roller 22. At the same time, the roller drive motor 57 and the agitator drive motor 63 are stopped. In this way, the developing roller 22 and the agitator 29 are stopped at the timing of when the transfer process is completed.

The toner image transferred onto the paper sheet 3 is fixed onto the paper sheet 3 by the fixing unit 13. Then, the paper sheet 3 is fed to the discharge roller 34. The discharge roller 34, which is driven by the driving force from the drum drive motor 51, discharges the paper sheet 3 onto the discharge tray 35 in S9. Discharge of the paper sheet 3 in S9 can be detected by the discharge sensor 47. Simultaneously, the drum drive motor 51 is stopped. In this way, the photosensitive drum 21 is stopped at a timing synchronized with the end of the discharge process.

In the above-described process, the timing for starting rotation of the developing roller 22 and the agitator 29 is determined by using the timer so that rotation starts after a predetermined time period has elapsed after the input signal is received. Then, the sheet feed operation is started when the received image data has been processed into print data. However, because the time period required for processing the received image data fluctuates depending on the amount of the received image data, the time period between when the developing roller 22 and the agitator 29 start rotating and when the sheet feed operation starts also fluctuates. Therefore, when the amount of the received image data is large, the developing roller 22 and the agitator 29 will rotate for an unnecessarily long period of time before the sheet feed operation starts. Next, a modification of the process of the pre-driving program will be described while referring to the flowchart represented in FIG. 12.

Figure 12:
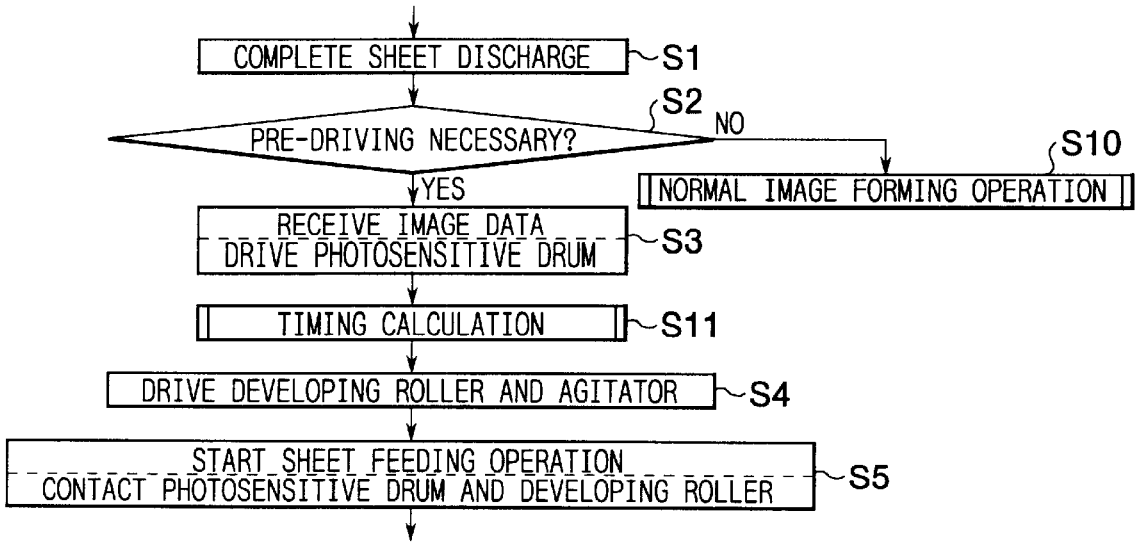
FIG. 12 is a flowchart representing a modification of the process of FIG. 11.

To prevent this problem, the timing calculation process can be modified in a manner to be described next with reference to the flowchart in FIG. 12. The process according to the present modification differs from the process described above in that a timing calculation process in performed in S11 after image data is received in S3.

That is, in the process according to the modification, the timing for starting the sheet feed operation is calculated in S11 based on the amount of the received image data, and also the timing for starting rotation of the developing roller 22 and the agitator 29 it calculated based on the calculated timing for the sheet feed operation so that the rotation starts a predetermined time duration, three seconds for example, before the sheet feed operation. With this configuration, when the amount of the received image data is small, the rotation start timing for the developing roller 22 and the agitator 29 is set to a short time after the detection of the input signal, and when the amount of the received image data is large, the rotation start timing is set to a long time after the detection of the input signal. In this way, the developing roller 22 and the agitator 29 are prevented from being rotated for an unnecessarily long period of time regardless of the amount of received image data, and yet for a sufficiently long period to provide the toner with an appropriate charge.

Alternatively, the timing calculation process in S11 can calculate the timing for starting the timer based on the amount of received image data. That is, in the process represented by the flowchart shown in FIG. 11 the timer is started when an input signal of received image data is detected. However, the timer can be started based on the amount of received image data, that is, to start later when a large amount of image data is received, and to start earlier when a small amount of image data is received. In this way, the roller drive motor 57 and the agitator drive motor 63 can be driven at an appropriate timing, regardless of the amount of received image data.

As described above, according to the present invention, the pre-driving program is performed to properly charge toner if a predetermined time period has elapsed after a preceding image forming operation has been completed or if toner charge is detected to be too low. Therefore, proper toner images can be obtained from the start of the next image forming operation. Also, because the developing roller 22 and the photosensitive drum 21 are separated from each other during the toner charging operation before the sheet feed operation is started, the developing roller 22 and the photosensitive drum 21 are prevented from being worn down.

In the above-described embodiment, both the developing roller 22 and the agitator 29 are driven simultaneously prior to the sheet feed operation according to the pre-driving program. With this configuration, both the toner carried on the developing roller 22 and the toner in the toner box 27 is charged for an extra period of times. This effectively prevents deterioration in image quality caused when toner is insufficiently charged at the beginning of the image forming process, even when forming graphics or other images that require large amounts of toner from the toner box 27.

However, the configuration can be modified according to the design of the image forming device and to conditions of image forming operations, so that one of the developing roller 22 and the agitator 29 can start rotating before the other.

Figure 14:
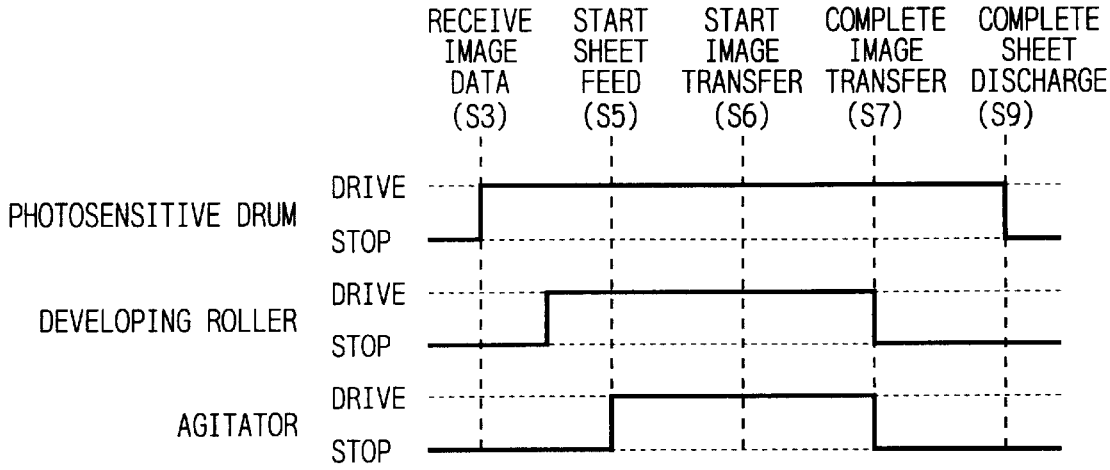
FIG. 14 is a timing chart showing drive timings of the photosensitive drum, the developing roller, and the agitator according to a modification of the pre-driving program.

FIG. 14 shows the drive timing for when the developing roller 22 starts rotating before the agitator 29 during the additional charge time operation. That is, when an image forming operation begins, the motor 51 is driven to rotate the photosensitive drum 21 simultaneously with timing of when image data is received from the host computer 70 via the interface 71. Next, the roller drive motor 57 is driven, thereby driving the developing roller 22 to rotate. Then, the sheet feed roller 7 starts the sheet feed operation to feed the paper sheet 3, the separating motor 106 brings the photosensitive drum 21 and the developing roller 22 into contact each other, and agitator drive motor 63 starts driving the agitator 29, all at the same time. Subsequently, the toner image is transferred from the photosensitive drum 21 onto the paper sheet 3. When the trailing edge of the paper sheet 3 passes between the photosensitive drum 21 and the transfer roller 26, the separating motor 106 separates the photosensitive drum 21 and the developing roller 22, and the roller drive motor 57 and the agitator drive motor 63 are stopped, thereby stopping rotation of the developing roller 22 and the agitator 29. When the paper sheet 3 is discharged, the drum drive motor 51 is stopped, thereby stopping the photosensitive drum 21.

By driving the developing roller 22 before the agitator 29 in the above-described manner, the toner carried on the developing roller 22 is charged for an extra period of time more than the toner in the toner box 27. This effectively prevents deterioration in the image quality caused when toner is insufficiently charged from the beginning of the image forming process when forming text or other images that do not consume a large amount of toner and toner carried on and from the vicinity of the developing roller 22 suffices. Also, excess stirring of toner by the agitator 29 can be prevented, thereby preventing degradation of the toner.

It should be noted that the agitator 29 can be controlled to start rotating before the sheet feed operation, rather than at the same timing as when the sheet feed operation is started.

Figure 15:
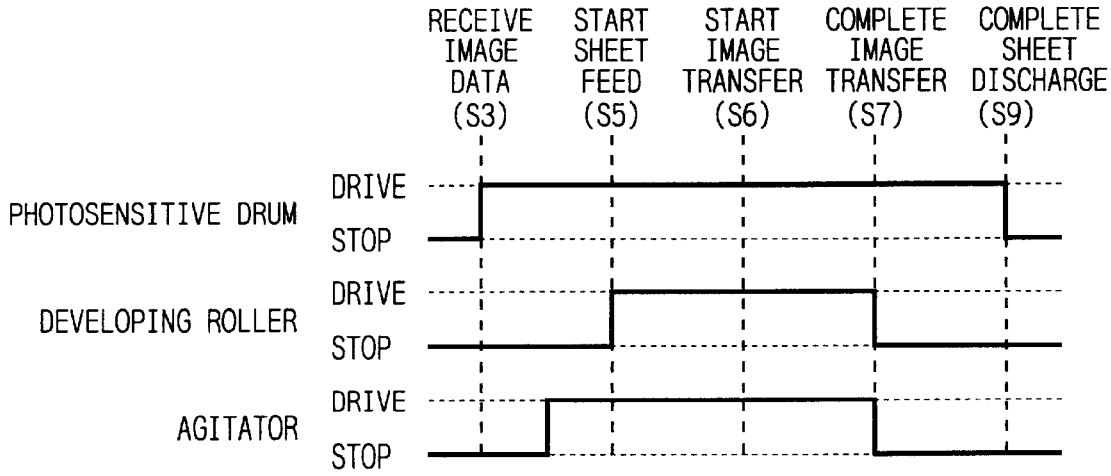
FIG. 15 is a timing chart showing drive timings of the photosensitive drum, the developing roller, and the agitator according to an another modification of the pro-driving program.

FIG. 15 shows the driving timing for when the agitator 29 starts rotating earlier than the developing roller 22. That is after the image forming operation begins, image data in received from the host computer 70 via the interface 71, and at the same time, the drum drive motor 51 is driven, thereby rotating the photosensitive drum 21. The agitator drive motor 63 is driven afterward, thereby rotating the agitator 29. Then, the sheet feed roller 7 feeds the paper sheet 3, the separating motor 106 brings the photosensitive drum 21 and the developing roller 22 into contact with each other, and the roller drive motor 57 drives the developing roller 22, all at the same time. A toner image is transferred from the photosensitive drum 21 onto the paper sheet 3. When the trailing edge of the paper sheet 3 passes between the photosensitive drum 21 and the transfer roller 26, the separating motor 106 separates the photosensitive drum 21 and the developing roller 22 from each other, and the roller drive motor 57 and the agitator drive motor 63 are stopped, thereby stopping the developing roller 22 and the agitator 29. When the paper sheet 3 is discharged, the drum drive motor 51 is stopped, thereby stopping the photosensitive drum 21.

By driving the agitator 29 before the developing roller 22 in the above-described manner, the toner in the toner box 27 is charged for an extra period of time more than the toner carried on the developing roller 22. This effectively prevents deterioration in the image quality caused when toner is insufficiently charged from the beginning of the image forming process, particularly when forming graphics or other images that consume a large amount of toner. This also effectively prevents deterioration of the developing roller 22 in contacting developing type laser printers 1, wherein the photosensitive drum 21 and the developing roller 22 contact each other, which tends to degrade the developing roller 22.

It should be noted that drive of the developing roller 22 can be started before the sheet feed operation, rather than simultaneous with start of the sheet feed operation.

Figure 7:
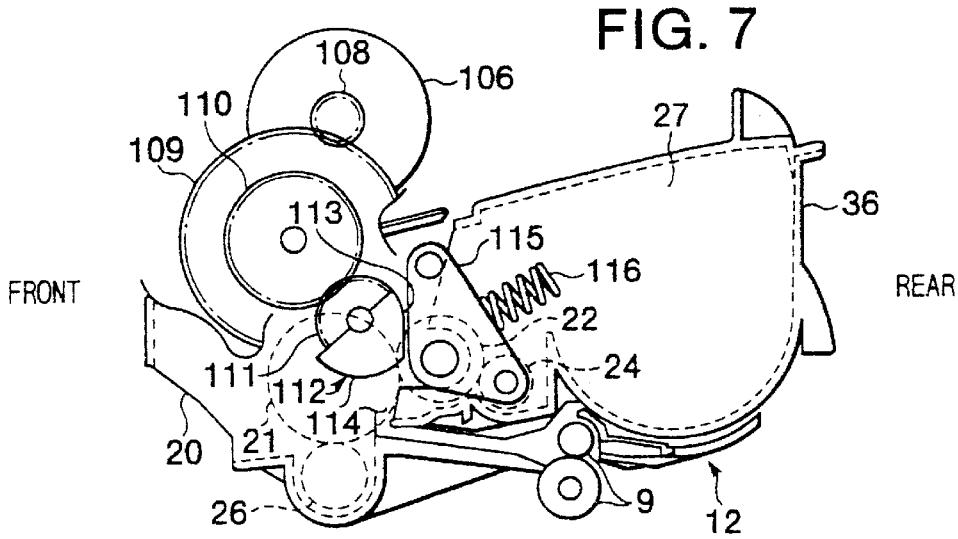
FIG. 7 is a side cross-sectional view showing a modification of the contact/separating mechanism of FIGS. 5 and 6.

FIGS. 6 and 7 show a modification of the present embodiment. Although the developing cartridge 36 is formed movable forward and rearward in relation to the drum cartridge in the above-described embodiment, the developing roller 22 is formed movable forward and rearward in relation to the photosensitive drum 21 in the present modification. Specifically, as shown in FIG. 7, a roughly triangularly shaped pushing member 115 is provided in place of the pivot arm 107. The pushing member 115 is supported on the drum cartridge 20 at its upper corner so as to be pivotable about the upper corner. The lower most corner of the pushing member 115 rotatably supports the roller shaft of the supply roller 24. The remaining corner of the pushing member 115 rotatably supports the roller shaft of the developing roller 22 which is disposed in front of the supply roller 24.

One end of a spring 116 is disposed on a slanted backside surface 115 of the pushing member 115, and the other end of the spring 116 is fixed on the main casing 2. The urging force of the spring 116 urges the pushing member 115 forward. Accordingly, the developing roller 22 and the supply roller 24 are also urged in the forward direction.

Figure 8:
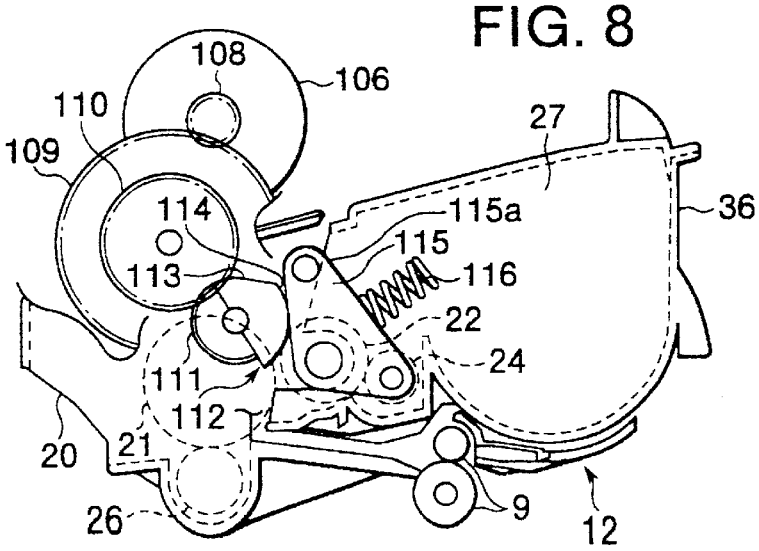
FIG. 8 is a side cross-sectional view showing a separating condition of the contact/separating mechanism of FIG. 7.

With this configuration, when the flat surface 113 opposes the pushing member 115 as shown in FIG. 7, the developing roller 22 contacts the photosensitive drum 21 because of the urging force of the spring 116. On the other hand, when the cam member 112 is rotated by the driving force of the separating motor 106, such that the distended surface portion 114 contacts the pushing member 115 as shown in FIG. 8, then the cam member 112 pushes the pushing member 115 in the rearward direction in opposition to the urging force of the spring 116. As a result, the developing roller 22 and the supply roller 24 are moved in the rearward direction, thereby separating the developing roller 22 from the photosensitive dram 21.

With this configuration, because the photosensitive drum 21 and the developing roller 22 contact and separate by the forward and rearward movement of the developing roller 22 in relation to the photosensitive drum 21, it is possible to construct the laser printer 1 in a further compact size.

While the invention has been described in detail with reference to specific embodiments thereof, it would be apparent to those skilled in the art that various changes and modifications may be made therein without departing from the spirit of the invention, the scope of which is defined b the attached claims.

For example, in the laser printer 1 described above, the photosensitive drum 21, the developing roller 22, and the agitator 29 are independently driven by the drum drive motor 51, the roller drive motor 57, and the agitator drive motor 63, respectively. However, it is also possible to drive the photosensitive drum 21, the developing roller 22, and the agitator 29 by a single drive motor. In this case, a clutch mechanism, such as a solenoid, for turning ON and OFF the transmission of the driving force of the single drive motor should be provided.

Figure 16:
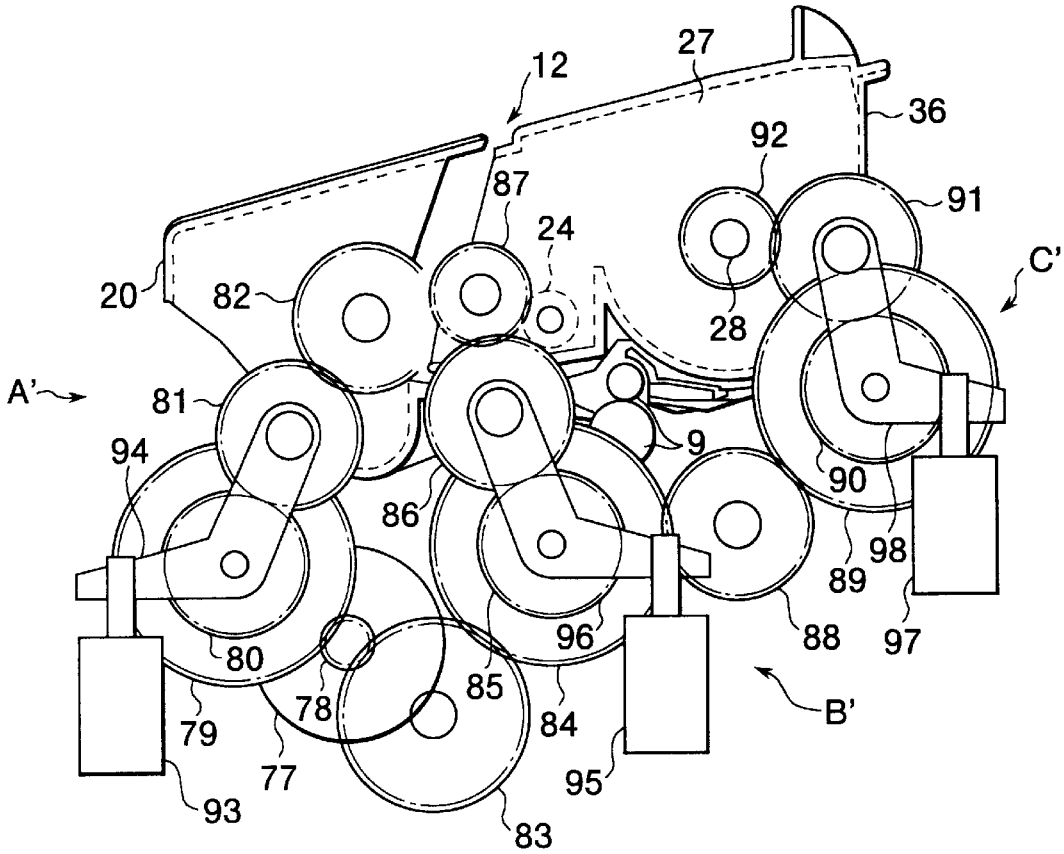
FIG. 16 is a side cross-sectional view showing a modification of the drive mechanisms of FIG. 2.

FIG. 16 shows an example of configuration of such driving mechanism. In FIG. 16, the driving mechanism includes a drive motor 77, a drum drive mechanism A', a roller drive mechanism B', and an agitator drive mechanism C'. The drive motor 77 is provided below the photosensitive drum 21 and provided with a pinion gear 78.

The drum drive mechanism A' includes an eleventh intermediate gear 79, a twelfth intermediate gear 80, a thirteenth intermediate gear 81, a photosensitive drum driving gear 82, a first am member 94, and a drum solenoid 93. The eleventh intermediate gear 79 engages with the pinion gear 78 from the above. The eleventh intermediate gear 79 is coaxially and integrally formed with the twelfth intermediate gear 80. The twelfth intermediate gear 80 has a smaller diameter than that of the eleventh intermediate gear 79. The thirteenth intermediate gear 81 is meshingly engaged with the twelfth intermediate gear 80. The photosensitive drum driving gear 82 is formed on the side of the photosensitive drum 21 in the axial direction of the photo-sensitive drum 22, and is meshingly engaged with the thirteenth intermediate gear 81.

The first arm member 94 is formed in the shape of an obtuse angle and is pivotally supported on the shaft of the eleventh intermediate gear 79 and the twelfth intermediate gear 80. One end of the first arm member 94 rotatable supports the thirteenth intermediate gear 81, and the other end is attached to the plunger shaft of the solenoid 93. The advance and retreat motion of the plunger shaft pivots the first arm member 94, thereby engaging and separating the thirteenth intermediate gear 81 and the photosensitive drum driving gear 82.

With this configuration, when the solenoid 93 is energized the gears 81 and 82 are brought into contact with each other, and the driving force from the drive motor 77 is transmitted via the pinion gear 78, the eleventh intermediate gear 79, the twelfth intermediate gear 80, the thirteenth intermediate gear 81, and the photosensitive drum driving gear 82 in this order to the photosensitive drum 21, thereby rotating the photosensitive drum 21. In other words, energizing the solenoid 93 ON and OFF starts and stops transmission of drive force from the drive motor 77 to the photosensitive drum 21.

The roller drive mechanism B' includes a fourteenth intermediate gear 83, a fifteenth intermediate gear 84, a sixteenth intermediate gear 85, a seventeenth intermediate gear 86, a developing roller driving gear 87, a second arm member 96, and a roller solenoid 95. The fourteenth intermediate gear 83 is meshingly engaged with the bottom of the pinion gear 78. The fifteenth intermediate gear 84 is meshingly engaged with the fourteenth intermediate gear 83. The fifteenth intermediate gear 84 is coaxially and integrally formed with the sixteenth intermediate gear 85. The sixteenth intermediate gear 85 has a smaller diameter than that of the fifteenth intermediate gear 84. The seventeenth intermediate gear 86 is meshingly engaged with the sixteenth intermediate gear 85. The developing roller driving gear 87 is formed on the side of the roller shaft on the developing roller 22 in the axial direction of the developing roller 22, and is meshingly engaged with the seventeenth intermediate gear 86.

The second arm member 96 is formed in an obtuse angle and pivotally supported on the shaft of the fifteenth intermediate gear 84 and the sixteenth intermediate gear 85. One end of the second arm member 96 rotatably supports the seventeenth intermediate gear 86, and the other end is attached to the plunger shaft of the roller solenoid 95. The advance and retreat movement of the plunger shaft pivots the second arm member 96, thereby engaging and separating the seventeenth intermediate gear 86 and the developing roller driving gear 87.

With this configuration, when the roller solenoid 95 is energized, the gears 86 and 87 are brought into meshing engagement, and the driving force of the drive motor 77 is transmitted via the pinion gear 78, the fourteenth intermediate gear 83, the fifteenth intermediate gear 84, the sixteenth intermediate gear 85, the seventeenth intermediate gear 86, and the developing roller driving gear 87 in this order to the developing roller 22, thereby rotating the developing roller 22. In other words, energizing the roller solenoid 95 ON and OFF starts and stops transmission of drive force from the drive motor 77 to the developing roller 22.

The agitator drive mechanism C' includes an eighteenth intermediate gear 88, a nineteenth intermediate gear 89, a twentieth intermediate gear 90, a twenty-first intermediate gear 91, an agitator driving gear 92, a third arm member 98, and an agitator solenoid 97. The eighteenth intermediate gear 88 is meshingly engaged with the fifteenth intermediate gear 84. The nineteenth intermediate gear 89 is meshingly engaged with the eighteenth intermediate gear 88. The nineteenth intermediate gear 89 is formed coaxially and integrally with the twentieth intermediate gear 90. The twentieth Intermediate gear 90 has a smaller diameter than that of the nineteenth intermediate gear 89. The twenty-first intermediate gear 91 is meshingly engaged with the twentieth intermediate gear 90. The agitator driving gear 92 is formed on the side of the rotating shaft 28 in the axial direction and engaged with the twenty-first intermediate gear 91. The third arm member 98 is formed in an obtuse angle and pivotally supported on the shaft of the nineteenth intermediate gear 89 and the twentieth intermediate gear 90. One end of the third arm member 98 rotatably supports the twenty-first intermediate gear 91, and the other end is attached to the plunger shaft of the agitator solenoid 97. The advance and retreat movement of the plunger shaft pivots the third arm member 98, thereby engaging and separating the twenty-first intermediate gear 91 and the agitator driving gear 92.

With this configuration, when the solenoid 97 is energized, the gears 91 and 92 are brought into meshing engagement, and the driving force of the drive motor 77 is transmitted via the fifteenth intermediate gear 84, the eighteenth intermediate gear 88, the nineteenth intermediate gear 89, the twentieth intermediate gear 90, the twenty-first intermediate gear 91, and the agitator driving gear 92 in this order to the rotating shaft 28 and in turn to the agitator 29, thereby rotating the agitator 29. Excitation and cancellation of the solenoid 97 turns ON and OFF the transmission of the drive force from the drive motor 77 to the agitator 29. The rotating shaft 28 supports the agitator 29.

In this way, the drive force of the drive motor 77 can be transmitted to the photosensitive drum 21, the developing roller 22, and the agitator 29 while controlled by the exciting and canceling in the drum solenoid 93, the roller solenoid 95, and the agitator solenoid 97.

Also, in the above-described embodiment, the separating motor 106 brings the photosensitive drum 21 and the developing roller 22 into contact at the same timing as the start of the sheet feed in S5. However, the photosensitive drum 21 and the developing roller 22 can be brought into contact with each other slightly before or after the start of the sheet feed. Also, in the above-described embodiment, the separating motor 106 separates the photosensitive drum 21 and the developing roller 22 in synchronization with stop timing of the roller drive motor 57 and the agitator drive motor 63 in S8. However, the roller drive motor 57 and the agitator drive motor 63 can be stopped after the photosensitive drum 21 and the developing roller 22 are separated.

According to the above described embodiment, the photosensitive drum 21 and the developing roller 22 contact each other during the developing process. However, there has been provided an image forming device wherein the developing process is performed with a gap separating the photosensitive drum and the developing roller, that is, the photosensitive drum and the developing roller do not contact each other at all. The present invention can be applied to such an image forming device. However, in this case, there is no need to control the photosensitive drum and the developing roller to contact and separate from each other.

Also, the drive times of the developing roller 22 and the agitator 29 can be changed according to the charge level of toner in the developing cartridge 36 or according to the time elapsed after the previous image forming operation was completed. Further, when forming images on a plurality of pages in one job, it is possible to leave the photosensitive drum 21 and the developing roller 22 in contact between pages in that job.

In the above-described embodiment, the arm driving mechanism D separates the photosensitive drum 21 and the developing roller 22 during the pre-driving operation, that is, when only the developing roller 22 is driven to rotate. However, the control unit 100 can control the arm driving mechanism D to separate these when only the photosensitive drum 21 is driven to rotate. The photosensitive drum 21 is driven to rotate while the developing roller 22 is not when cleaning operations are performed for recovering residual toner remaining on the photosensitive drum 21.

Also, although in the above-described embodiment, both the developing roller 22 and the agitator 29 are controlled to be driven during the pre-driving operation, only one of the developing roller 22 and the agitator 29 can be driven during the pro-driving operation.

As described above, according to the present invention, when a charge of the toner has dropped below a predetermined charging amount, a pre-driving operation is performed during the subsequent image forming operation so that at least one of the developing drum 22 and the agitator 29 is driven to rotate before the sheet feed operation stars. Therefore, sufficient charge can be applied to the toner before a developing operation starts, thereby providing a high-quality image. Also, because the photosensitive drum 21 and the developing roller 22 are separated from each other during the pre-driving operation, the photosensitive drum 21 and the developing roller 22 are prevented from being worn out.

What is claimed is:

1. A developing device used in an image forming device including a feeding mechanism that feeds a recording medium, comprising:

a photosensitive member;

a developing agent chamber housing a developing agent;

a developing unit that selectively supplies the developing agent housed in the developing agent chamber to the photosensitive member;

a contact/separating mechanism that selectively contacts and separates the photosensitive member and the developing unit; and a driving member that drives the developing unit, wherein the contact/separating mechanism separates the photosensitive member and the developing unit from each other when the driving member starts driving the developing unit before the feeding mechanism starts feeding the recording medium.

2. The developing device according to claim 1, further comprising a judging unit that judges whether a charging amount of the developing agent is sufficient when an image forming operation is started, wherein when the judging unit judges that the charging amount of the developing agent is insufficient, the driving member starts driving the developing unit before the feeding mechanism starts feeding the recording medium.

3. The developing device according to claim 2, wherein the judging unit includes a charging amount detecting sensor that detects the charging amount of the developing agent, and the judging unit judges that the charging amount of the developing agent is insufficient when the charging amount detected by the charging amount detecting sensor is below a predetermined charging amount.

4. The developing device according to claim 3, wherein the judging unit judges that the charging amount of the developing agent is insufficient when the charging amount detected by the charging amount detecting sensor is below 15 $\mu$C/g.

5. The developing device according to claim 2, wherein the judging unit includes a time measuring unit that measures a time duration between when a preceding image forming operation is completed and when a subsequent image forming operation is started, and the judging unit judges that the charging amount of the developing agent is insufficient when the time measuring unit has measured a time duration longer than a predetermined time duration.

6. The developing device according to claim 5, wherein the judging unit judges that the charging amount of the developing agent is insufficient when the time measuring unit has measured three minutes or more.

7. The developing device according to claim 2, wherein the developing unit includes a rotatable developing roller, and wherein when the judging unit judges that the charging amount of the developing agent is insufficient, the driving member drives the developing roller to rotate at least one full rotation before the feeding mechanism starts feeding the recording medium.

8. The developing device according to claim 1, further comprising an agitating member housed in the developing agent chamber, the agitating member agitating the developing agent housed in the developing agent chamber.

9. The developing device according to claim 8, wherein the driving member individually drives the developing unit and the agitating member.

10. The developing device according to claim 8, further comprising a judging unit that judges whether a charging amount of the developing agent is sufficient when an image forming operation is started, wherein when the judging unit judges that the charging amount of the developing agent is insufficient, the driving member starts driving the developing unit before the feeding mechanism starts feeding the recording medium.

11. The developing device according to claim 10, wherein when the judging unit judges that the charging amount of the developing agent is insufficient, the driving member drives both the developing unit and the agitating member at the same time before the feeding mechanism starts feeding the recording medium.

12. The developing device according to claim 10, wherein when the judging unit judges that the charging amount of the developing agent is insufficient, the driving member drives both the developing unit and the agitating member before the feeding mechanism starts feeding the recording medium, the driving member starts driving one of the developing unit and the agitating member before remaining one of the developing unit and the agitating member.

13. The developing device according to claim 1, wherein the driving member starts driving the developing unit after a predetermined time duration elapses after the image data has been received.

14. The developing device according to claim 13, further comprising a control unit that determines a feeding timing based on an amount of the image data, wherein the feeding mechanism starts feeding the recording medium at the feeding timing.

15. The developing device according to claim 14, wherein the driving member starts driving the developing unit, a predetermined time duration before the feeding timing.

16. The developing device according to claim 13, further comprising a timing unit that determines a driving timing based on an amount of the image data, wherein the driving mechanism starts driving the developing unit at the driving timing.

17. A developing device, comprising:

a photosensitive member;

a developing agent chamber housing a developing agent;

a developing unit that supplies the developing agent housed in the developing agent chamber to the photosensitive member;

a contact/separating mechanism that selectively contacts and separates the photosensitive member and the developing unit;

a judging unit that judges whether a charging amount of the developing agent is sufficient or insufficient; and a driving member that drives the developing unit in a condition where the photosensitive member and the developing unit are being separated from each other, wherein when the judging unit judges that the charging amount of the developing agent is insufficient, the driving member drives the developing unit for a time duration longer than when the judging unit judges that the charging amount of the developing agent is sufficient.

18. An image forming device for performing an image forming operation, comprising:

a feeding mechanism that feeds a recording medium;

a photosensitive member;

a developing agent chamber housing a developing agent;

a developing unit that selectively supplies the developing agent housed in the developing agent chamber to the photosensitive member;

a contact/separating mechanism that selectively contacts and separates the photosensitive member and the developing unit; and a driving member that drives the developing unit, wherein when the contact/separating mechanism separates the photosensitive member and the developing unit from each other when the driving member starts driving the developing unit before the feeding mechanism starts feeding the recording medium.

19. The developing device according to claim 18, further comprising a judging unit that judges whether a charging amount of the developing agent is sufficient when the image forming operation is started, wherein when the judging unit judges that the charging amount of the developing agent is insufficient, the driving member starts driving the developing unit before the feeding mechanism starts feeding the recording medium.

20. The image forming device according to claim 19, wherein the judging unit includes a charging amount detecting sensor that detects the charging amount of the developing agent, and the judging unit judges that the charging amount of the developing agent is insufficient when the charging amount detected by the charging amount detecting sensor is below a predetermined charging amount.

21. The image forming device according to claim 19, wherein the judging unit includes a time measuring unit that measures a time duration between when a preceding image forming operation is completed and when a subsequent image forming operation is started, and the judging unit judges that the charging amount of the developing agent is insufficient when the time measuring unit has measured a time duration longer than a predetermined time duration.

22. An image forming device comprising:

a photosensitive member;

a developing roller that selectively supplies toner to the photosensitive member;

a separating mechanism that separates the photosensitive member and the developing roller from each other;

a rotating mechanism that rotates the developing roller in a condition where the photosensitive member and the developing roller are being separated from each other; and a control unit that controls the rotation of the developing roller in accordance with a time duration from an end of a previous image forming operation to a start of a subsequent image forming operation.

23. The image forming device according to claim 22, wherein the control unit controls the rotating mechanism to rotate the developing roller when the time duration is longer than a predetermined time duration.

24. An image forming device comprising:

a photosensitive member;

a developing roller that selectively supplies toner to the photosensitive member;

a separating mechanism that separates the photosensitive member and the developing roller from each other;

a rotating mechanism that rotates the developing roller in a condition where the photosensitive member and the developing roller are being separated from each other; and a control unit that controls the rotation of the developing roller in accordance with a charging amount of the toner.

25. The image forming device according to claim 24, wherein the control unit controls the rotating mechanism to rotate the developing roller when the charging amount of the toner is lower than a predetermined charging amount.

* * * * *